US010139099B2

(12) United States Patent
Ivey et al.

(10) Patent No.: US 10,139,099 B2
(45) Date of Patent: Nov. 27, 2018

(54) LIGHT RING LOUDSPEAKER SYSTEM

(71) Applicant: Mitek Corp., Inc., Phoenix, AZ (US)

(72) Inventors: Johnathan Ivey, Chandler, AZ (US); Kevin Sykes, Phoenix, AZ (US)

(73) Assignee: Mitek Corp., Inc., Phoenix, AZ (US)

( * ) Notice: Subject to any disclaimer, the term of this patent is extended or adjusted under 35 U.S.C. 154(b) by 143 days.

(21) Appl. No.: 15/239,273

(22) Filed: Aug. 17, 2016

(65) Prior Publication Data

US 2018/0051872 A1 Feb. 22, 2018

(51) Int. Cl.

| | |
|---|---|
| ***F21V 33/00*** | (2006.01) |
| ***H04R 1/02*** | (2006.01) |
| ***F21S 8/02*** | (2006.01) |
| *F21Y 115/10* | (2016.01) |
| *F21Y 113/17* | (2016.01) |
| *F21Y 105/18* | (2016.01) |

(52) U.S. Cl.

CPC ..... *F21V 33/0056* (2013.01); *F21S 8/026* (2013.01); *H04R 1/026* (2013.01); *H04R 1/028* (2013.01); *F21Y 2105/18* (2016.08); *F21Y 2113/17* (2016.08); *F21Y 2115/10* (2016.08); *H04R 2201/021* (2013.01)

(58) Field of Classification Search

CPC ..... F21V 33/0056; H04R 1/026; H04R 1/028

See application file for complete search history.

(56) References Cited

U.S. PATENT DOCUMENTS

| | | | | |
|---|---|---|---|---|
| 7,784,957 | B2 * | 8/2010 | Wright | F21V 33/0056 362/86 |
| 8,672,087 | B2 * | 3/2014 | Stewart, Jr. | H04R 1/02 181/148 |
| 2007/0064433 | A1 * | 3/2007 | Wright | F21V 33/0056 362/364 |
| 2015/0225948 | A1 * | 8/2015 | Behling | E04B 9/32 52/173.1 |
| 2017/0089567 | A1 * | 3/2017 | Penrod | F21V 33/0056 |

* cited by examiner

*Primary Examiner* — Joseph L Williams

(74) *Attorney, Agent, or Firm* — Keith K. Jenkins, Registered Patent Attorney, LLC; Keith L. Jenkins

(57) ABSTRACT

An LED light ring for ceiling mounted speakers having flanged enclosures with flip dogs is presented. The LED light ring is a flat annular transparent or translucent piece that is clamped between the enclosure flange and the ceiling tile and emits RGB LED light radially outward through the LED light ring. The LED light emits from LEDs mounted on a circular electronic circuit board (flexible or not) on the inner circumference of the LED light ring. The circular electronic circuit is coupled to a controller that controls the color, blink rate, and intensity and has firmware for interpreting simple controller commands into complex LED light patterns and sequences. A plurality of light ring equipped loudspeakers may be in communication with a common controller that can create patterns and sequences among the plurality of light ring equipped loudspeakers.

20 Claims, 7 Drawing Sheets

LIGHT RING LOUDSPEAKER SYSTEM

FIELD OF ART

The present invention relates to a ceiling-mounted speaker housing having an LED light ring sandwiched between a ceiling tile and a housing flange that is visible below the ceiling tile. The present invention more particularly relates to such LED light ring that is controllable as to color and intensity of light, and systems of LED light ring equipped speakers.

BACKGROUND OF THE INVENTION

Ceiling speakers have housings which are designed to assist in mounting ceiling speakers on ceiling tiles of suspended ceilings. The housing may include an enclosure, or "can", a circumferential horizontal flange extending from the enclosure at the bottom, a circumferential vertical wall on the flange that is sized to slidingly fit in a mounting hole in the ceiling tile, and clamps, or "flip dogs", for clamping the ceiling tile between the horizontal flange and the flip dogs. There is a demand for ceiling lighting and sound systems, particularly in integrated form, for large office buildings with suspended ceilings. Some approaches have been made toward using lights on speakers for purposes other than ordinary illumination for reading, typing, etc. It is desired to integrate speakers and lighting for signaling and alarms.

OBJECTS OF THE INVENTION

It is an object of this invention to provide an LED light ring that is controllable as to color, intensity, and blinking. It is a further object of this invention to provide an LED light ring that can be easily retrofitted on previously installed ceiling speakers.

SUMMARY OF THE INVENTION

Briefly described, the invention includes a flat annular piece, or ring, of transparent or translucent material having an outer diameter at least as large as a ceiling speaker horizontal flange and having an inner diameter slightly larger than a circumferential vertical wall of the ceiling speaker housing that defines the size of the hole in the ceiling tile in which the speaker housing is mounted. On the inner surface of the annular piece is affixed a thin strip of circuit board on which is mounted a plurality of LEDs, preferably RGB LEDS, which LEDS abut the inner surface of the annular piece and shine light radially outward through the flat annular piece. Optionally, the outer surface of the annular piece may be optically diffusive by means of surface treatment or coating. Optionally, the circuit board may feature radially inward standoff s to snugly fit the LED light ring to the vertical circumferential housing wall without abutting the circuitry to the vertical circumferential housing wall. The LEDs are controllable in color, blink rate and intensity by a controller, optionally in combination with firmware on the circuit board. A plurality of such LED light ring speakers may have a common controller to generate lighting sequences and patterns among the plurality of such LED light ring speakers.

An embodiment provides a light ring loudspeaker, including: a loudspeaker enclosure having an annular circumferential flange adapted to engage a ceiling tile or a panel when the enclosure is inserted through a hole in the either the ceiling tile and the panel, respectively, where the annular circumferential flange has a larger diameter than the hole; a plurality of flip dogs mounted on the enclosure, adapted to clamp either the ceiling tile or the panel between the flip dogs and the annular circumferential flange; and an annular ring adapted to be clamped between the annular circumferential flange and either the ceiling tile or the panel. That light ring loudspeaker, including a loudspeaker mounted within the enclosure. That light ring loudspeaker, where the annular ring is either translucent or transparent. That light ring loudspeaker, including a circular electronic circuit mounted on an inner circumferential surface of the annular ring. That light ring loudspeaker, where the circular electronic circuit includes: a flexible circular electronic circuit or a rigid circular electronic circuit. That light ring loudspeaker, including a plurality of LEDs mounted on the circular electronic circuit. That light ring loudspeaker, where each LED of the plurality of LEDs has its light output directed though the annular ring. That light ring loudspeaker, where each LED of the plurality of LEDs is an RGB LED. That light ring loudspeaker, where the circular electronic circuit is in communication with a controller adapted to control a color, blink rate, and/or intensity of an output of the plurality of LEDs. That light ring loudspeaker, where the circular electronic circuit includes firmware adapted to interpret simple commands from the controller into complex LED output pattern generation. That light ring loudspeaker, including a plurality of the light ring loudspeakers attached to a common controller adapted to control the color, blink rate, and/or intensity of the output of the plurality of LEDs of each the light ring loudspeaker of the plurality of the light ring loudspeakers to form sequences and patterns.

An embodiment provides a loudspeaker enclosure having an annular circumferential flange adapted to engage either a ceiling tile or a panel when the enclosure is inserted through a hole in either the ceiling tile or the panel, respectively, where the annular circumferential flange has a larger diameter than the hole; a plurality of flip dogs mounted on the enclosure, adapted to clamp the ceiling tile or the panel between the flip dogs and the annular circumferential flange; an annular ring adapted to be clamped between the annular circumferential flange and the ceiling tile or the panel; where the annular ring is either translucent or transparent; and a circular electronic circuit mounted on an inner circumferential surface of the annular ring. That light ring loudspeaker, where the circular electronic circuit includes one of: a flexible circular electronic circuit; and a rigid circular electronic circuit. That light ring loudspeaker, including a plurality of LEDs mounted on the circular electronic circuit. That light ring loudspeaker, where each LED of the plurality of LEDs has its light output directed though the annular ring. That light ring loudspeaker, where each LED of the plurality of LEDs is an RGB LED. That light ring loudspeaker, where the circular electronic circuit is in communication with a controller adapted to control the color, blink rate, and intensity of the output of the plurality of LEDs. That light ring loudspeaker, where the circular electronic circuit includes firmware adapted to interpret simple commands from the controller into complex LED output pattern generation. That light ring loudspeaker, including a plurality of the light ring loudspeakers attached to a common controller adapted to control the color, blink rate, and intensity of the output of the plurality of LEDs of each the light ring loudspeaker of the plurality of the light ring loudspeakers to form sequences and patterns.

An embodiment provides a loudspeaker enclosure having an annular circumferential flange adapted to engage either a ceiling tile or a panel when the enclosure is inserted through a hole in either the ceiling tile or the panel, where the annular circumferential flange has a larger diameter than the hole; a plurality of flip dogs mounted on the enclosure, adapted to clamp either the ceiling tile or the panel between the flip dogs and the annular circumferential flange; an annular ring adapted to be clamped between the annular circumferential flange and either the ceiling tile or the panel; where the annular ring is either translucent or transparent; a circular electronic circuit mounted on an inner circumferential surface of the annular ring; where the circular electronic circuit includes either a flexible circular electronic circuit or a rigid circular electronic circuit; a plurality of LEDs mounted on the circular electronic circuit; where: each LED of the plurality of LEDs has its light output directed though the annular ring; and each LED of the plurality of LEDs is an RGB LED; where: the circular electronic circuit is in communication with a controller adapted to control the color, the blink rate, and the intensity of the output of the plurality of LEDs; the circular electronic circuit includes firmware adapted to interpret simple commands from the controller into complex LED output pattern generation; and a plurality of the light ring loudspeakers attached to a common controller adapted to control the color, the blink rate, and the intensity of the output of the plurality of LEDs of each light ring loudspeaker of the plurality of the light ring loudspeakers to form sequences and patterns of LED outputs.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 1:
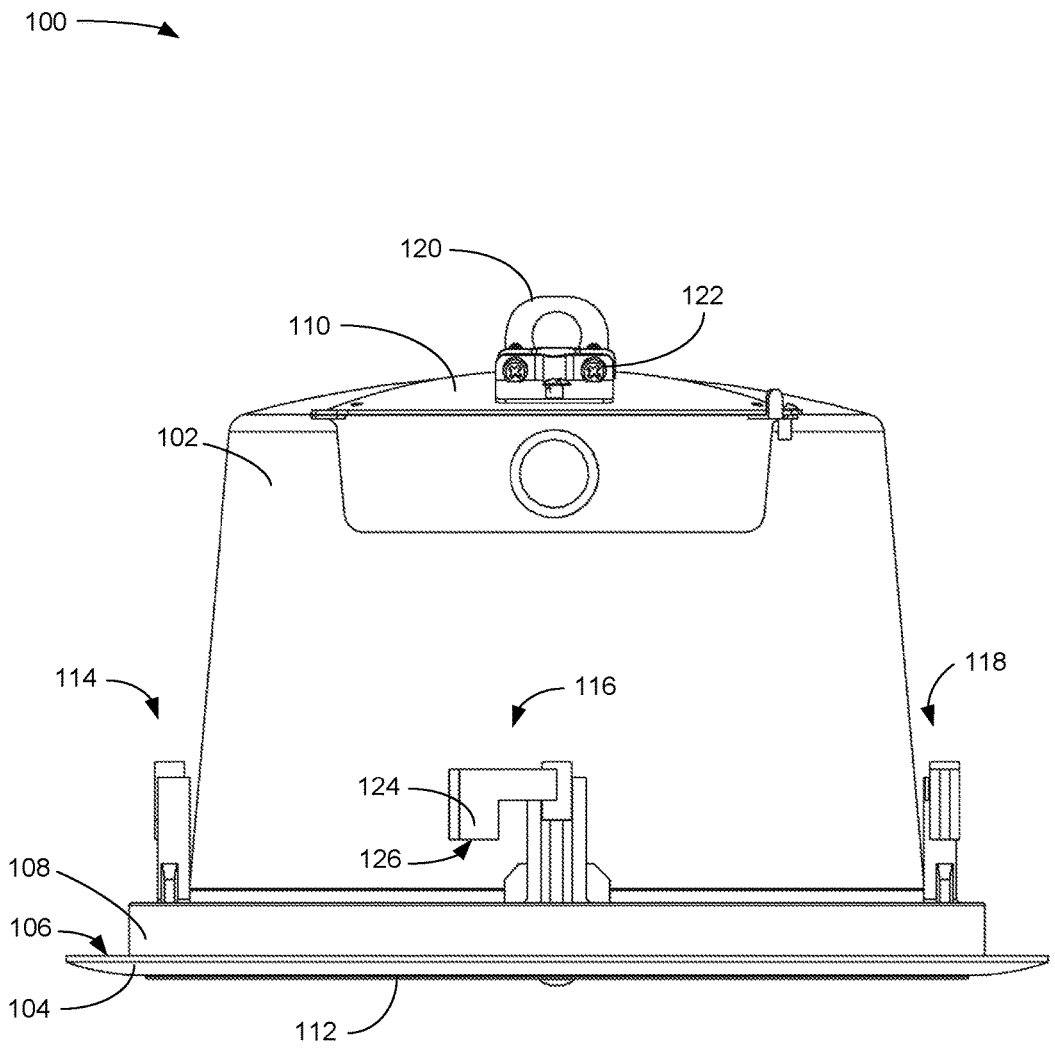
FIG. 1 is side elevation view illustrating an exemplary embodiment of the loudspeaker housing for the light ring loudspeaker, according to a preferred embodiment of the present invention.

FIG. 1 is side elevation view illustrating an exemplary embodiment of the loudspeaker housing 100 for the light ring loudspeaker 200 (see FIG. 2), according to a preferred embodiment of the present invention. Enclosure 102 preferably contains a downward-facing speaker and is generally radially symmetrical. Speaker access panel 110 supports cable guide 120 and speaker electrical connections 122. Extending horizontally from the bottom is an annular circumferential flange 104 having a top surface 106. Annular circumferential flange 104 supports circumferential vertical wall 108 which is sized to slidingly fit into a hole 306 in a ceiling tile 302 (see FIG. 3). A speaker grill 112 covers the diaphragm of an enclosed speaker and a bottom opening in the center of the annular circumferential flange 104 through which the speaker is inserted into enclosure 102. Arranged around the enclosure 102 and between the enclosure 102 and the circumferential vertical wall 108 are a plurality of dogleg clamps 114, 116 and 118 (hereinafter "flip dogs") having doglegs 124 (one of three visible labeled) which, during installation, rotate to a radially extended position and clamp the ceiling tile 302 (see FIG. 3) between the top surface 106 of annular circumferential flange 104 and the bottom surface 126 of doglegs 124.

Figure 2:
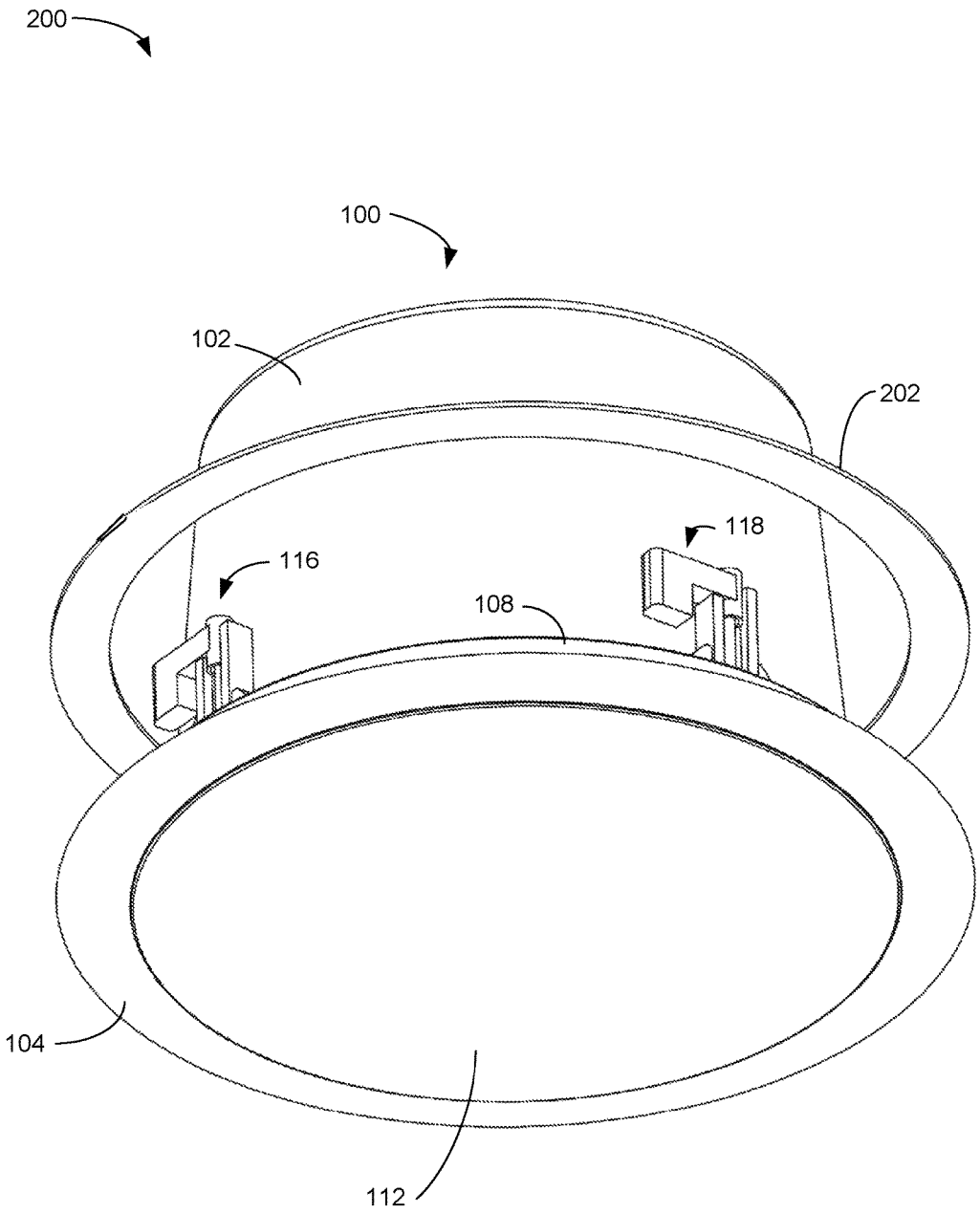
FIG. 2 is a front-side perspective view illustrating an exemplary embodiment of the light ring loudspeaker of FIG. 1, according to a preferred embodiment of the present invention.

FIG. 2 is a front-side perspective view illustrating an exemplary embodiment of the light ring loudspeaker 200, according to a preferred embodiment of the present invention. Light ring 202 is shown in an intermediate position during installation. Light ring 202 will rest on top surface 106 of annular circumferential flange 104. The outer diameter of the light ring 202 is preferably at least as large as the diameter of the annular circumferential flange 104. The inner diameter of the light ring 202 is slightly larger than the diameter of the circumferential vertical wall 108. Light ring 202 does not engage the flip dogs 116 and 118 in the stowed position of flip dogs 116 and 118. Light ring 202 is preferably an LED light ring 202, and more preferably an RGB LED light ring 202.

Figure 3:
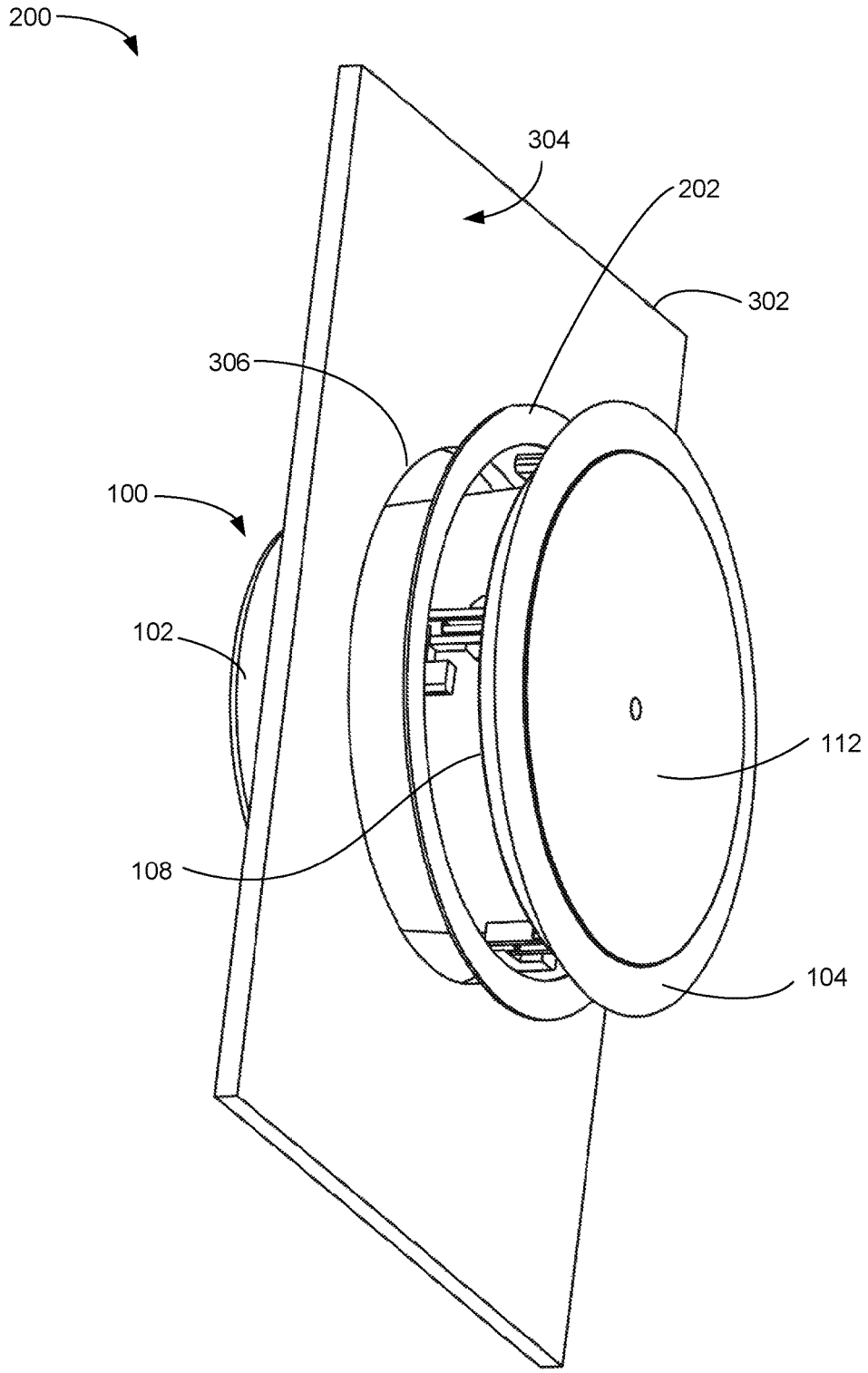
FIG. 3 is a front-side perspective view illustrating an exemplary embodiment of the light ring loudspeaker of FIG. 2, according to a preferred embodiment of the present invention.

FIG. 3 is a front-side perspective view illustrating an exemplary embodiment of the light ring loudspeaker 200 of FIG. 2, according to a preferred embodiment of the present invention. Enclosure 100, preferably with a loudspeaker enclosed therein, is inserted through the light ring 202 and then through hole 306 of ceiling tile 302. The inner diameter of light ring 202 and the hole 306 may fit slidingly or loosely around circumferential vertical wall 108. Ceiling tile 302 has a bottom surface 304, a portion of which will contact a top surface of light ring 202 in a further step of installation. Ceiling tile 302 may be any commercial-off-the-shelf ceiling tile 302 with enough strength to support the speaker enclosure 100 and speaker, or may be a wall panel of similar strength. Enclosure 100 and the enclosed speaker may be provided in various sizes and weights.

Figure 4:
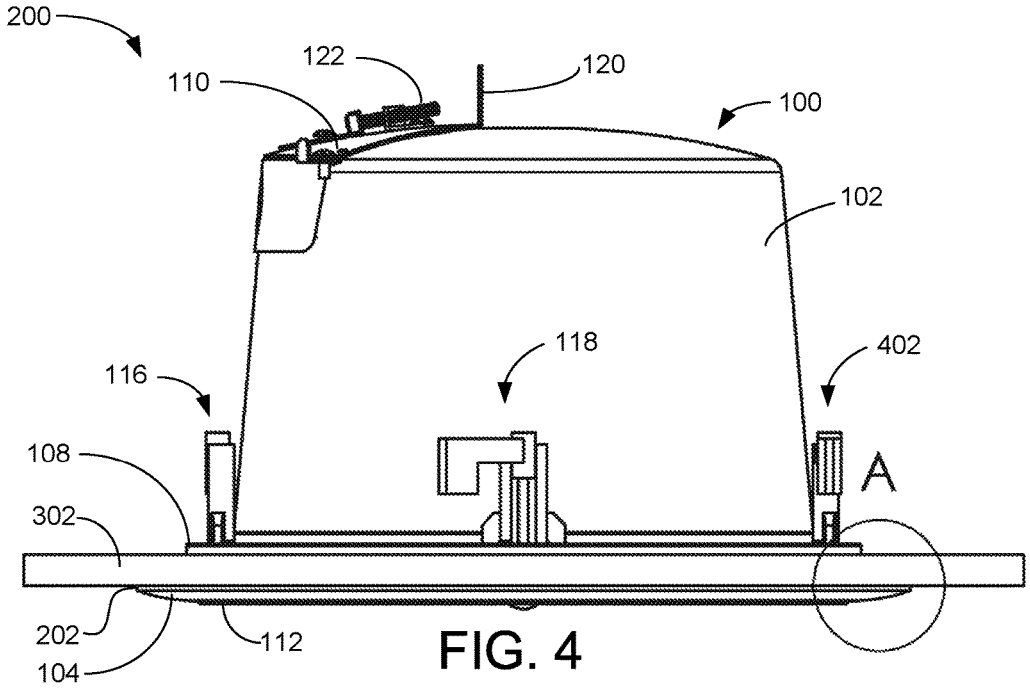
FIG. 4 is a side elevation view illustrating an exemplary embodiment of the light ring loudspeaker of FIG. 2 and delimiting a section A, according to a preferred embodiment of the present invention.

FIG. 4 is a side elevation view illustrating an exemplary embodiment of the light ring loudspeaker 200 of FIG. 2 and delimiting a section A, according to a preferred embodiment of the present invention. Light ring 202 is sandwiched between the annular circumferential flange 104 and the bottom surface 304 of the ceiling tile 302 in preparation for activating the flip dogs 116, 118, and 402. The number of flip dogs 114, 116, 118, and 402 illustrated herein are not a limitation of the present invention. For example, in other embodiments, more or fewer flip dogs may be used. The particular design of the flip dogs 114, 116, 118, and 402 is likewise not a limitation of the present invention.

Figure 5:
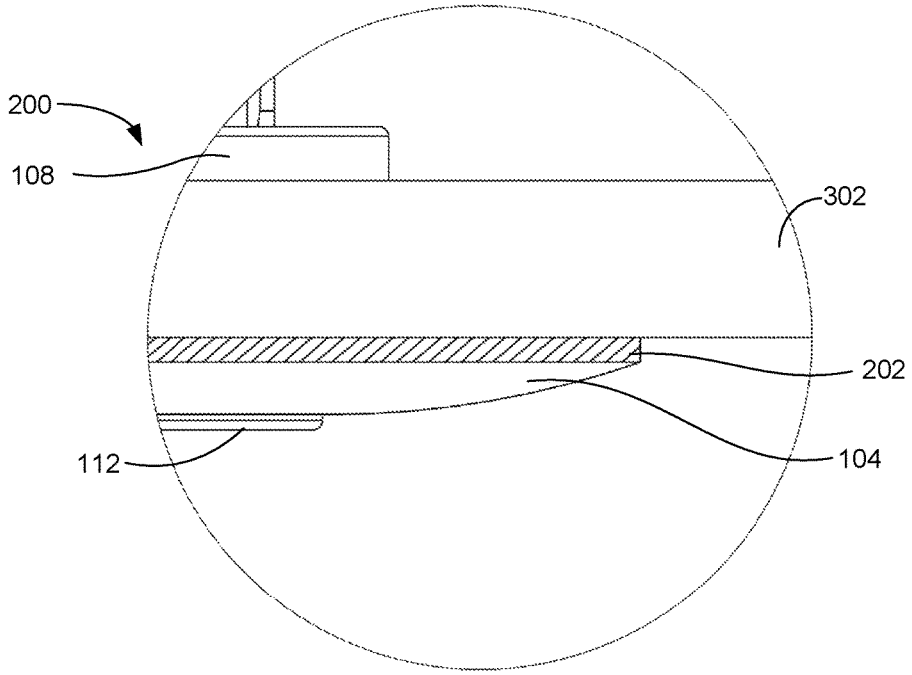
FIG. 5 is a front elevation view illustrating an exemplary embodiment of the light ring loudspeaker of FIG. 2, showing details of section A of FIG. 4, according to a preferred embodiment of the present invention.

FIG. 5 is a front elevation view illustrating an exemplary embodiment of the light ring loudspeaker 200 of FIG. 1, showing details of section A of FIG. 4, according to a preferred embodiment of the present invention. Light ring 202 is shown sandwiched between ceiling tile 302 and annular circumferential flange 104. Both light ring 202 and ceiling tile 302 are outside of circumferential vertical wall 108 and will be clamped between the bottom surface 126 of a flip dog leg 124 and the annular circumferential flange 104 in the final step of installation. In other embodiments, light ring 202 may extend beyond annular circumferential flange 104.

Figure 6:
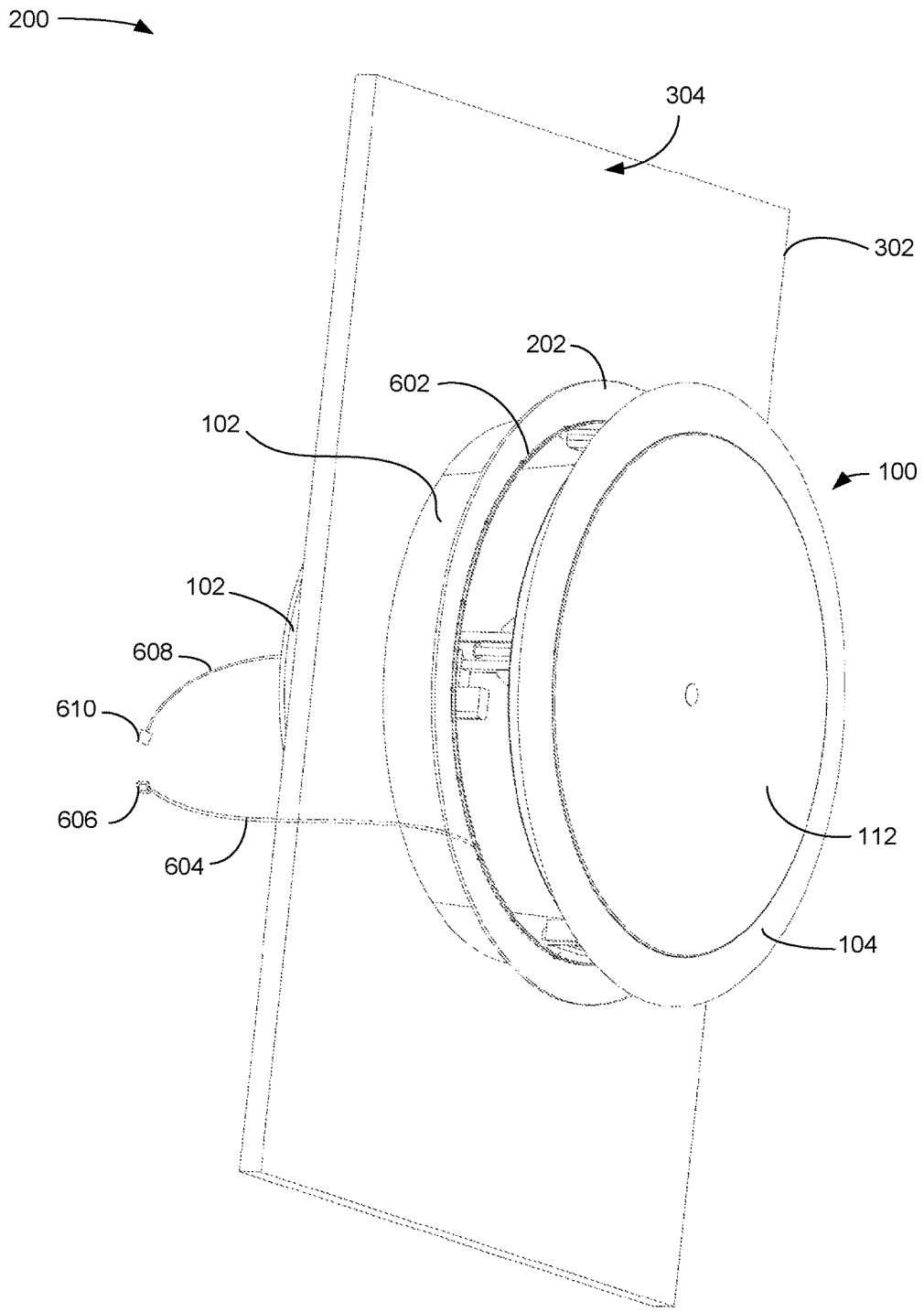
FIG. 6 is a front-side perspective view illustrating an exemplary embodiment of the light ring loudspeaker of FIG. 2, according to a preferred embodiment of the present invention.

FIG. 6 is a front-side perspective view illustrating an exemplary embodiment of the light ring loudspeaker 200 of FIG. 2, according to a preferred embodiment of the present invention. Light ring 202 is shown with a circular circuit 602, which may be a flexible circular circuit 602, attached to the inner surface of light ring 202. Circular circuit 602 supports a plurality of LEDs 904 (see FIG. 9) oriented to project light radially outward through the at least partially transparent annular ring 702 (see FIG. 7). Wires 604, which carry power and control information from a controller, are connected to circular circuit 602. Wires 602 terminate in electrical coupling 606 which is connectable to coupling 610 connected to a power and control data supply (controller) via wires 608. Control data may be used to change the color, intensity, or blinking of the LEDs 904 (see FIG. 9) on the light ring 202. A plurality of light ring loudspeakers 200 may be installed and controlled to signal actions in an emergency. For example, the light rings may turn emit red light and flash in a marquee sequence to indicate a path of escape. In a particular embodiment, the LEDs 904 (see FIG. 9) may be controlled to provide a marquee display or a double marquee display on a single light ring 202. For example, in a smoke-filled hallway where a person can only see one light ring loudspeaker 200, marquee flashing of the LEDs 904 (see FIG. 9) on both the left and right sides of the light ring 202 can still indicate an escape path.

Figure 7:
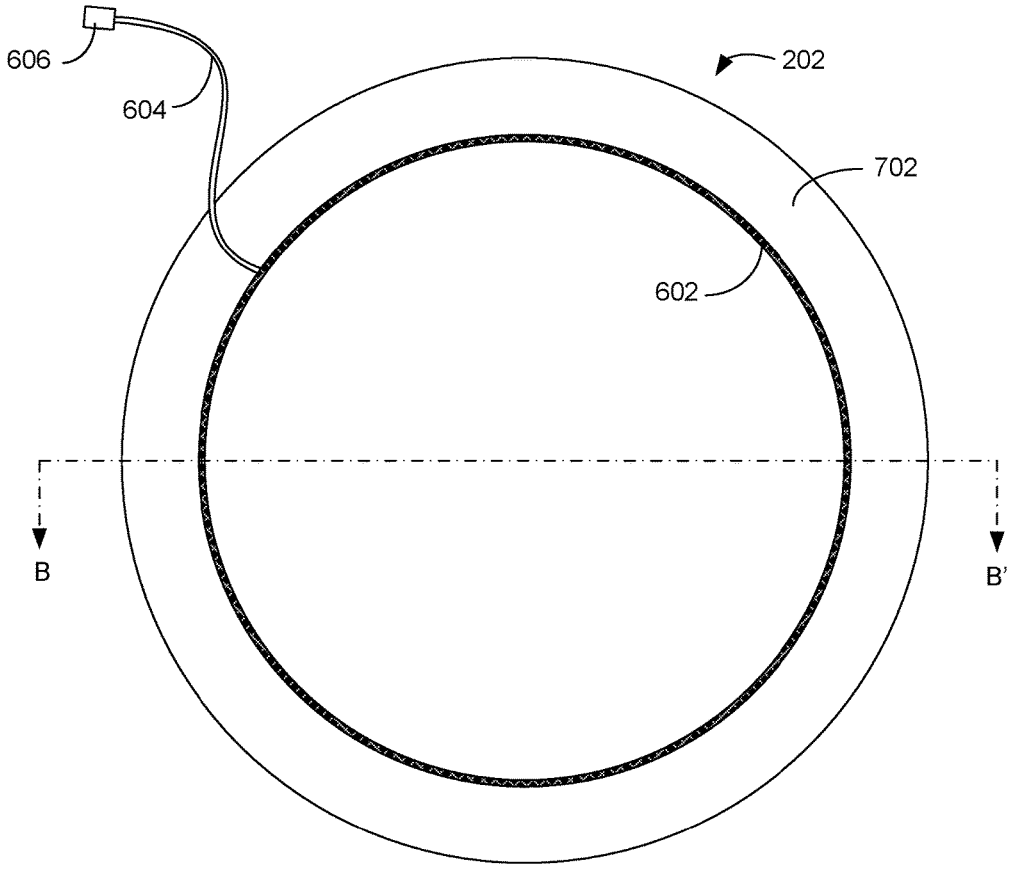
FIG. 7 is a top plan view illustrating an exemplary embodiment of the light ring of the light ring loudspeaker of FIG. 2 and defining cross section BB', according to a preferred embodiment of the present invention.

FIG. 7 is a top plan view illustrating an exemplary embodiment of the light ring 202 of the light ring loudspeaker 200 of FIG. 2 and defining cross section BB', according to a preferred embodiment of the present invention. Annular ring 702 is preferably made of a plastic that is at least partially transparent. Translucent annular rings 702 may be used in various embodiments. In particular embodiments, other transparent materials may be used, such as, without limitation, glass. In particular embodiments, annular ring 702 may be translucent by virtue of a light diffusing surface treatment (textured or applied) on the outer circumference of the annular ring 702. Annular ring 702 need not be rigid, but it should have enough stiffness to support the circular circuit 602. Circular circuit 602 may contain firmware that enables complex LED patterns and sequences in response to a simple controller command, such as, without limitation, a fire alarm command.

Figure 8:
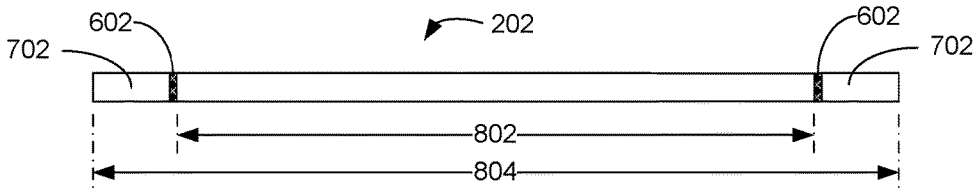
FIG. 8 is a side elevation view illustrating an exemplary embodiment of the light ring of the light ring loudspeaker of FIG. 2 through cross section BB' defined in FIG. 7, according to a preferred embodiment of the present invention.

FIG. 8 is a side elevation view illustrating an exemplary embodiment of the light ring 202 of the light ring loudspeaker 200 of FIG. 2 through cross section BB' defined in FIG. 7, according to a preferred embodiment of the present invention. Inner diameter 802 must be large enough to fit over the circumferential vertical wall 108. Outer diameter 804 is preferably at least as large as the diameter of the annular circumferential flange 104.

Figure 9:
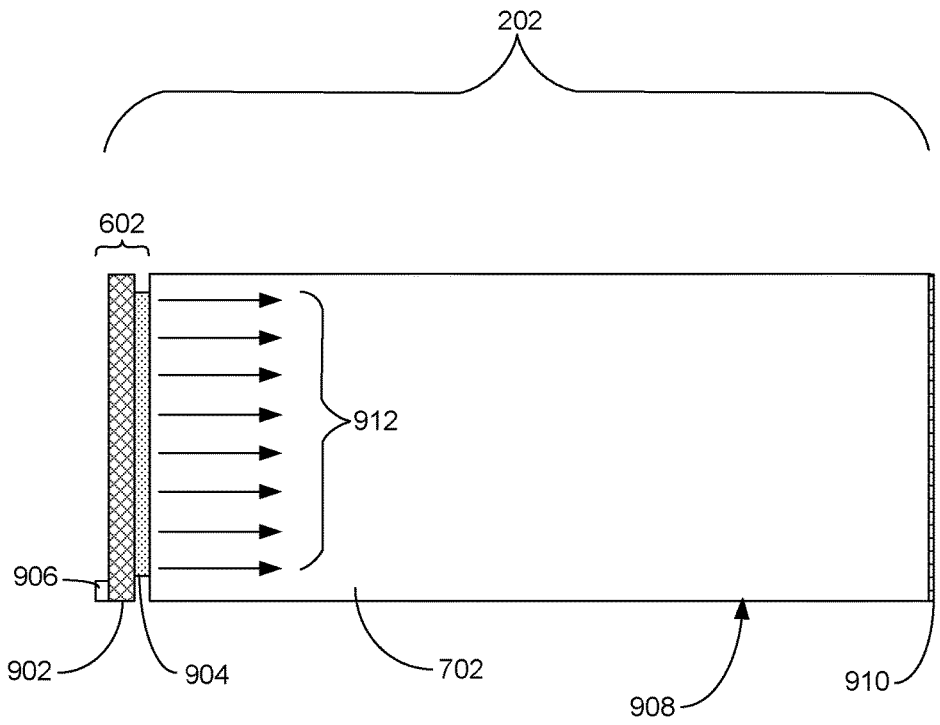
FIG. 9 is a side elevation enlarged view illustrating an exemplary embodiment of the light ring of the light ring loudspeaker of FIG. 2 through cross section BB' defined in FIG. 7, according to a preferred embodiment of the present invention.

FIG. 9 is a side elevation enlarged view illustrating an exemplary embodiment of a detail of the light ring 202 of the light ring loudspeaker 202 of FIG. 2 through cross section BB' defined in FIG. 7, according to a preferred embodiment of the present invention. Circular circuit includes LEDs 904, circuit board 902 and, optionally, stand-off 906. LEDs 904 are adhered to annular ring 702 and direct their light output 912 radially outward towards the outer edge of annular ring 702. LEDs 904 are supported by and electrically in communication with circuit board 902. Optional standoff 906 extends from circuit board 902 and is sized to keep circuit board 902 from abutting annular circumferential flange 104. In various embodiments, standoff 906 may be positioned elsewhere on the circuit board 902. Diffusive surface treatment 910 may be a coating or a roughing of the outer surface of annular ring 702. In a particular embodiment, the diffusive treatment may include a dust repellent coating. In particular embodiments where the outer diameter 804 of the light ring 202 is greater than the diameter of annular circumferential flange 104, any portion of bottom surface 908 that is exposed to view should also receive diffusive surface treatment 910.

While some exemplary embodiments have been illustrated, the invention is limited only by the claims below as interpreted in light of the specification above.

We claim:

1. A light ring loudspeaker, comprising:

a. a loudspeaker enclosure having an annular circumferential flange adapted to engage one of a ceiling tile and a panel when said enclosure is inserted through a hole in said one of said ceiling tile and said panel, respectively, wherein said annular circumferential flange has a larger diameter than said hole;

b. a plurality of flip dogs mounted on said enclosure, adapted to clamp said one of said ceiling tile and said panel between said flip dogs and said annular circumferential flange; and c. an annular ring adapted to be clamped between said annular circumferential flange and said one of said ceiling tile and said panel.

2. The light ring loudspeaker of claim 1, comprising a loudspeaker mounted within said enclosure.

3. The light ring loudspeaker of claim 1, wherein said annular ring is one of translucent and transparent.

4. The light ring loudspeaker of claim 3, comprising a circular electronic circuit mounted on an inner circumferential surface of said annular ring.

5. The light ring loudspeaker of claim 4, wherein said circular electronic circuit comprises one of:

a. a flexible circular electronic circuit; and b. a rigid circular electronic circuit.

6. The light ring loudspeaker of claim 5, comprising a plurality of LEDs mounted on said circular electronic circuit.

7. The light ring loudspeaker of claim 6, wherein each LED of said plurality of LEDs has its light output directed though said annular ring.

8. The light ring loudspeaker of claim 6, wherein each LED of said plurality of LEDs is an RGB LED.

9. The light ring loudspeaker of claim 8, wherein said circular electronic circuit is in communication with a controller adapted to control at least one of a color, a blink rate, and an intensity of an output of said plurality of LEDs.

10. The light ring loudspeaker of claim 9, wherein said circular electronic circuit comprises firmware adapted to interpret simple commands from said controller into complex LED output pattern generation.

11. The light ring loudspeaker of claim 9, comprising a plurality of said light ring loudspeakers attached to a common controller adapted to control at least one of said color, blink rate, and intensity of said output of said plurality of LEDs of each said light ring loudspeaker of said plurality of said light ring loudspeakers to form sequences and patterns.

12. A light ring loudspeaker, comprising:

a. a loudspeaker enclosure having an annular circumferential flange adapted to engage one of a ceiling tile and a panel when said enclosure is inserted through a hole in said one of said ceiling tile and said panel, respectively, wherein said annular circumferential flange has a larger diameter than said hole;

b. a plurality of flip dogs mounted on said enclosure, adapted to clamp said one of said ceiling tile and said panel between said flip dogs and said annular circumferential flange;

c. an annular ring adapted to be clamped between said annular circumferential flange and said one of a ceiling tile and a panel;

d. wherein said annular ring is one of translucent and transparent; and e. a circular electronic circuit mounted on an inner circumferential surface of said annular ring.

13. The light ring loudspeaker of claim 12, wherein said circular electronic circuit comprises one of:

a. a flexible circular electronic circuit; and b. a rigid circular electronic circuit.

14. The light ring loudspeaker of claim 13, comprising a plurality of LEDs mounted on said circular electronic circuit.

15. The light ring loudspeaker of claim 14, wherein each LED of said plurality of LEDs has its light output directed though said annular ring.

16. The light ring loudspeaker of claim 15, wherein each LED of said plurality of LEDs is an RGB LED.

17. The light ring loudspeaker of claim 16, wherein said circular electronic circuit is in communication with a controller adapted to control at least one of a color, a blink rate, and an intensity of said output of said plurality of LEDs.

18. The light ring loudspeaker of claim 17, wherein said circular electronic circuit comprises firmware adapted to interpret simple commands from said controller into complex LED output pattern generation.

19. The light ring loudspeaker of claim 18, comprising a plurality of said light ring loudspeakers attached to a common controller adapted to control said color, blink rate, and intensity of said output of said plurality of LEDs of each said light ring loudspeaker of said plurality of said light ring loudspeakers to form sequences and patterns.

20. A light ring loudspeaker, comprising:

a. a loudspeaker enclosure having an annular circumferential flange adapted to engage one of a ceiling tile and a panel when said enclosure is inserted through a hole in said one of ceiling tile and a panel, wherein said annular circumferential flange has a larger diameter than said hole;

b. a plurality of flip dogs mounted on said enclosure, adapted to clamp said one of a ceiling tile and a panel between said flip dogs and said annular circumferential flange;

c. an annular ring adapted to be clamped between said annular circumferential flange and said one of a ceiling tile and a panel;

d. wherein said annular ring is one of translucent and transparent;

e. a circular electronic circuit mounted on an inner circumferential surface of said annular ring;

f. wherein said circular electronic circuit comprises one of:

i. a flexible circular electronic circuit; and ii. a rigid circular electronic circuit;

g. a plurality of LEDs mounted on said circular electronic circuit;

h. wherein:

i. each LED of said plurality of LEDs has its light output directed though said annular ring; and ii. each LED of said plurality of LEDs is an RGB LED;

i. wherein:

i. said circular electronic circuit is in communication with a controller adapted to control said color, blink rate, and intensity of said output of said plurality of LEDs;

ii. said circular electronic circuit comprises firmware adapted to interpret simple commands from said controller into complex LED output pattern generation; and j. a plurality of said light ring loudspeakers attached to a common controller adapted to control said color, blink rate, and intensity of said output of said plurality of LEDs of each said light ring loudspeaker of said plurality of said light ring loudspeakers to form sequences and patterns of LED outputs.

* * * * *